United States Patent [19]

Ignatiev et al.

[11] 4,136,718

[45] Jan. 30, 1979

[54] APPARATUS FOR MAKING SERPENTIFORM SPRINGS

[76] Inventors: Alexei K. Ignatiev, Volgogradsky prospekt, 71, kv. 167; Rusaam S. Nemets, Sirenevy bulvar, 57, kv. 50; Efim S. Gorbulev, Tovarischesky pereulok, 9/11, kv. 5; Elena N. Stolyarova, Varshavskoe shosse, 65, korpus 2, kv. 220, all of Moscow; Jury M. Kontsov, ulitsa Krasnova, 1, kv. 58, Odessa, all of U.S.S.R.

[21] Appl. No.: 859,794

[22] Filed: Dec. 12, 1977

[51] Int. Cl.[2] ..... B21F 35/04

[52] U.S. Cl. ..... 140/105; 140/90

[58] Field of Search ..... 140/71 R, 90, 91, 105; 72/190, 191

[56] References Cited

U.S. PATENT DOCUMENTS 2,188,407 1/1940 Horton ..... 140/105

*Primary Examiner*—Lowell A. Larson

*Attorney, Agent, or Firm*—Lackenbach, Lilling & Siegel

[57] ABSTRACT

In an apparatus, synchronous rotation of a driven drum supporting mandrel pins and of two plates rotating in the same direction is effected. The plates support bending rods to bend rod stock on either side about successively arranged pins.

The portion of the stock being bent and the preceding bent portion are securely urged against respective pins by means of a pair of spring-loaded shoes.

2 Claims, 5 Drawing Figures

APPARATUS FOR MAKING SERPENTIFORM SPRINGS

Field of the Invention

The invention relates to metal forming and may be used in the manufacture of serpentiform springs.

DESCRIPTION OF THE PRIOR ART

Known in the art is an apparatus for making serpentiform springs, comprising a drum having freely fitted pins, a ratchet mechanism, a disc cam engaging the drum pins, a carriage having bending rods and a roller for retracting the pins of the drum (cf. USSR Inventor's Certificate No. 369,961, Cl. B21D 11/06 of Oct. 2, 1970).

The disadvantages of the prior art apparatus consist of a complicated kinematic chain, cyclic movement of the tool (drum with pins and carriage with bending rods) and, therefore, low productivity and insufficient accuracy of the resultant serpentiform spring since, depending on the quality of the material, the stock is not uniformly urged against the drum pin about which the stock is bent. Consequently, the dimensions of the serpentiform spring being made vary both in length and width.

SUMMARY OF THE INVENTION

It is an object of the invention to provide an apparatus for making serpentiform springs of metal tape which enables the manufacture of serpentiform spring at high speed due to continuous bending of the metal tape.

It is another object of the invention to provide an apparatus for making serpentiform springs of metal tape, which enables the manufacture of an improved quality spring featuring high-accuracy of pre-set dimensions of the finished article due to the provision in the apparatus of elements ensuring constant pitch and width.

It is still another object of the invention to provide an apparatus for making a serpentiform spring of metal tape, which is simple in manufacture and operation and is reliable.

And, finally, it is an object of the invention to provide a bending apparatus which enables an accurate bending "on the edge" and production of a flat serpentiform spring of high dimensional accuracy of upset steel wire having substantially rectangular cross-section.

For the accomplishment of these and other objects, the apparatus, according to the invention, for making serpentiform springs by bending rod stock comprises a rotary drum having radially extending pins on the cylindrical surface thereof. The starting rod stock extending along a tangent line to the drum surface is bent about the pins. A mechanism for retracting the pins at the portion before the bending zone and for bringing them out at the bending portion is included. Movable bending rods are caused to move on either side of the starting rod stock for urging it against the pins at the moment of the formation of the serpentiform spring. The apparatus is characterized in that the bending rods are mounted on bearing plates rotating in the same direction and having their axes of rotation parallel to each other and to the axes of the bending rods which are arranged on either side of the bending portion relative to the feed plane of the rod stock and at a right angle thereto. There are provided spring-loaded shoes located on either side of the bending portion transversely of the rod stock being fed, one shoe urging the rod stock against the pin about which the bending is effected, and the other shoe urging the stock against the preceding pin.

This construction permits the starting rod stock to be bent at high speed about the drum pins while retaining an accurate positioning of the bent portions of the serpentiform spring being made relative to the pins leaving the bending zone.

In accordance with an embodiment of the invention, there is provided an apparatus for making serpentiform spring, characterized in that the bearing plates comprise double arm bodies having a central axis of rotation. Each arm supports the bending rod engaging a cam of the mechanism for retracting the pin after its participation in the bending process. The rotary drive of the plates is in a force transmitting connection with the rotary drive of the drum, the following condition being provided:

$$\frac{n_1}{n_2} = \frac{Z_2}{2Z_1},$$

wherein $n_1$ is the number of revolutions of the plates per minute, $n_2$ is the number of revolutions of the drum per minute, $Z_1$ is the number of bending rods of the plate, and $Z_2$ is the number of pins of the drum.

This construction enables the desired synchronization of rotation of the driven drum and plates supporting the bending rods to provide for high-performance continuous bending of serpentiform spring.

BRIEF DESCRIPTION OF THE INVENTION

The invention will now be described with reference to specific embodiments thereof illustrated in the accompanying drawings, in which.

DETAILED DESCRIPTION OF THE INVENTION

A tape is bent on the edge into a serpentiform stock in the apparatus for making serpentiform springs.

Figure 1:
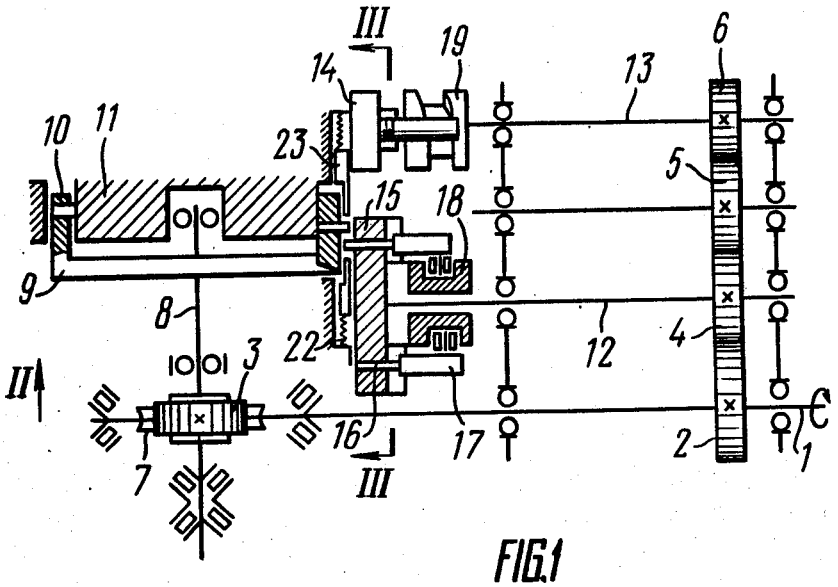
FIG. 1 shows a kinematic chain of the apparatus according to the invention.
Figure 2:
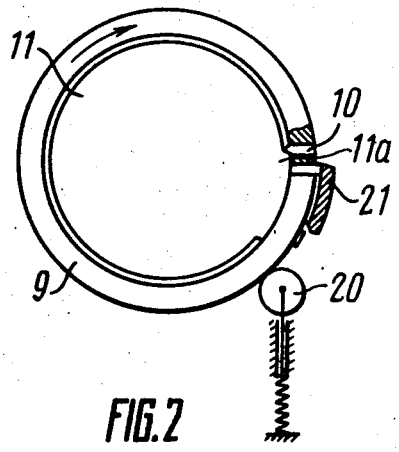
FIG. 2 shows the drum with pins and a fixed cam in the apparatus of FIG. 1.
Figure 3:
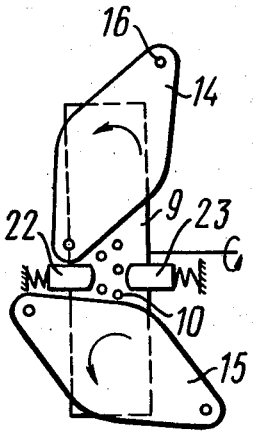
FIG. 3 is a cross sectional view taken along the line III—III in FIG. 1 showing the arrangement of the bearing plates.
Figure 4:
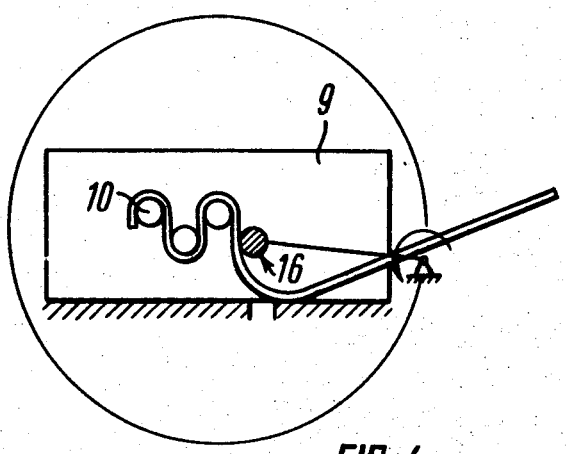
FIGS. 4 and 5 show the position of the plate shaft depending on the shape of the serpentiform spring.
Figure 5:
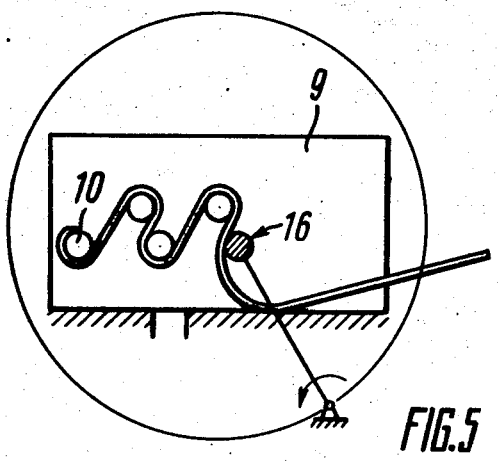

The apparatus for making serpentiform springs, according to the invention, comprises a shaft 1 (FIG. 1) having a pin on 2 and a worm 3 which are in a force transmitting connection with gears 4, 5 and 6 and a worm wheel 7, respectively. A worm wheel shaft 8 supports a drum 9 having pins 10 (FIG. 2).

The pins 10 are arranged in the drum 9 radially and in a staggered pattern so as to obtain the desired pitch and width of the serpentiform stock. The pins 10 are received in sockets of the drum with a running fit (with play) so as to facilitate smooth radial movement of the pins 10 in the drum 9.

The drum 9 accommodates a fixed disc cam 11. The disc cam 11 is provided to limit the stroke of the pins 10 into the interior of the drum. The disc cam 11 has a projection 11a which causes the pins 10 to move outside the drum prior to the beginning of bending and holds the pins in the outmost position until the serpentiform spring is removed from the pins 10.

The gears 4 and 6 are fixed to shafts 12 and 13, respectively supporting bearing plates 14 and 15, respectively having sockets which receive bending rods 16 with a running fit, the rods being connected, by means of rollers 17, to fixed cylindrical cams 18 and 19, respectively.

The gears 2, 4, 5 and 6, the worm gear 3, and the worm wheel 7 provide, via the shafts 1, 12, and 13, for uniform rotation of the bearing plates 14 and 15 supporting the bending rods 16 and of the drum 9 in the following ratio $$\frac{n_1}{n_2} = \frac{Z_2}{2Z_1},$$

wherein $n_1$ is the number of revolutions of the plates per minute, $n_2$ is the number of revolutions of the drum per minute, $Z_2$ is the number of the pins 10 of the drum 9, $Z_1$ is the number of the bending rods 16 of the plate.

The axes of the plates are arranged in such a manner that at the moment when the bending rod 16 and the tape pass the rod 10, the minimum clearance between the bending rod 16 and the pin 10 is equal to the tape width, while the component of linear speed of the bending rod 16 parallel with the linear speed of the drum is at least equal to, or more than, the linear speed of the drum.

The plates 14 and 15 and the drum 9 define, in the bending zone, an aperture of a size of 1.05–1.1 of the tape thickness thus enabling tape bending on the edge. The cams 18 and 19 ensure, by means of the rollers 17, the engagement of the tape by the bending rods 16 before the bending zone and the travel of the rods over the tape after the tape is bent on the edge about the pin 10.

The plates 14 and 15 provide for positioning of the tape by the bending rods 16 at the pins 10 of the drum 9 and bending of the tape about the pins 10 (at 180°).

A spring-loaded roller 20 is located on the left hand side of the bending zone of the drum 9 to remove the serpentiform stock from the pins 10 and to retract the pins 10 into the sockets of the drum 9.

A stop 21 is provided on the left hand side of the bending zone and is spaced from the drum 9 at a distance greater than the tape thickness to retain several bent portions of the serpentiform stock on the pins 10, which is necessary to eliminate stretching of the tape in the preceding turns thus ensuring stable width of the serpentiform stock. The same function is performed by spring-loaded shoes (pressors) 22 and 23 arranged on either side of the pins 10 to urge the tape against the pins 10 axially of the drum 9 at the moment of bending.

The apparatus functions in the following manner.

The tape end is passed between the two last pins of the drum 9 brought out by a camming surface 11a of the cam 11.

If the pin 10 which is the last to be brought out is located on the left hand side of the drum 9, the tape is bent about it by the bending rod 16 mounted on the upper plate 14. Concurrently with bending, the bent tape is fed, together with the pins 10 of the drum 9, under the stop 21 and is urged against the pin 10 by the spring loaded shoe (pressor) 22.

After the bending of the tape about the left hand pin 10 is completed and the bending rod 16 of the plate 14 has passed over the right hand pin 10 of the drum 9, the right hand pin 10 is brought out by the camming surface of the cam 11.

The bending rod 16 of the plate 14 continues its travel over the camming surface of the cam 18 to be spaced from the drum 9 and to pass over the tape. Then the tape is bent about the right hand pin 10 by the bending rod 16 of the lower plate 15. Concurrently with bending, the bent tape is fed, together with the pins 10 of the drum 9, under the stop 21 and is urged against the pin 10 by the spring-loaded shoe (pressor) 23.

The serpentiform spring passes the stop 21 and leaves the pins 10 of the drum 9, while the pins 10 are retracted by the spring loaded roller 20 located behind the stop 21.

The use of a composite three-member oil piston ring of steel tape:

- reduces metal consumption during manufacture due to the smaller metal weight compared to the box-shaped cast iron ring;
- lowers the manufacturing cost since the construction of the piston ring enables the employment of the most advanced manufacturing methods (winding, bending, rolling); and
- improves labor conditions in the manufacture since there is no need of the casting and machining stages involved in the manufacture of cast iron oil piston rings.

We claim:

1. An aparatus for making serpentiform springs by bending rod stock, comprising: a cylindrical drum rotatable about its axis: a plurality of pins arranged in a chain at a pre-set spacing over the entire cylindrical surface of said drum and radially relative to the axis of the drum; means for successively bending starting rod stock alternately about said pins, said means including bearing plates rotating in the same direction and having axes of rotation parallel to each other and extending on either side of the bending portion relative to the feed plane of the rod stock at a right angle thereto; bending rods mounted on said plates parallel to their axes of rotation; spring-loaded shoes located on either side of the bending portion transversely of the rod stock being fed, one of said shoes urging the rod stock against the pin about which the bending is effected at a given moment, and another shoe urging the bent stock against the preceding pin; and means for retracting said pins axially into said drum of the portions before and after the bending zone.

2. An apparatus for making serpentiform springs as claimed in claim 1, wherein the bearing plates comprise double arm bodies with a central axis of rotation, each arm supporting the bending rod engaging a cam of the mechanism for retracting the rod after its participation in the bending process, the rotary drive of the plates being in a force transmitting connection with the rotary drive of the drum with the following condition being provided:

$$\frac{n_1}{n_2} = \frac{Z_2}{2Z_1},$$

wherein $n_1$ is the number of revolutions of the plates per minute, $n_2$ is the number of revolutions of the drum per minute, $Z_1$ is the number of bending rods of the plate, $Z_2$ is the number of pins of the drum.

* * * * *